United States Patent [19]

Houston

[11] Patent Number: 4,615,506

[45] Date of Patent: Oct. 7, 1986

[54] SLIDE VALVE

[76] Inventor: James L. Houston, 4422 S. Mingo Rd., Tulsa, Okla. 74146

[21] Appl. No.: 740,382

[22] Filed: Jun. 3, 1985

[51] Int. Cl.[4] ..... F16K 3/314

[52] U.S. Cl. ..... 251/326; 251/329; 137/375; 137/315

[58] Field of Search ..... 137/468, 375, 315; 251/326, 327, 328, 329, 162, 163, 203, 204

[56] References Cited

U.S. PATENT DOCUMENTS 4,378,817 4/1983 Houston ..... 137/315

*Primary Examiner*—Martin P. Schwadron
*Assistant Examiner*—John S. Starsiak, Jr.
*Attorney, Agent, or Firm*—Head, Johnson & Stevenson

[57] ABSTRACT

This is a new slide valve arrangement. It includes a housing having a longitudinal axis and a disc valve or gate movable by an external hydraulic or mechanical actuator. The gate slides along a first surface of a guide member. There is a throat member through which the material to be regulated is directed. The throat supports a fixed wedge which is thin on the exterior and has a greater thickness on the interior. A movable wedge having an inclined surface mating with the incline surface of the fixed wedge is provided. Means are provided to position the movable wedge between the guide member and the inclined surface of the fixed wedge such that as the temperature of the valve increases, the movable wedge is forced tighter and tighter between the fixed wedge and the guide member. This give additional compressive strength to the valve.

6 Claims, 6 Drawing Figures

SLIDE VALVE

BACKGROUND OF THE INVENTION

This invention relates to a slide valve having a gate or disc which may be rectangular in shape which is movable along a guide member to open, close or partly open or close the throat of the slide valve through which the fluid flows.

A typical slide valve is shown in my U.S. Pat. No. 4,378,817 issued Apr. 5, 1983 and entitled "SLIDE VALVE ASSEMBLY". The invention disclosed herein is an improvement of the disclosure in that patent.

SUMMARY OF THE INVENTION

This is a slide valve assembly which makes for a slide valve which is stronger when hot than the prior art valves when hot. The assembly includes a housing having a longitudinal axis and a disc valve or gate which is movable linearly by an outside actuator. The gate moves along a first surface of a guide member. A throat through which the incoming fluid flows is also provided. A fixed wedge, supported from the valve housing through the throat, has an inclined surface outside the flow path. A movable wedge is provided between the inclined surface and the guide member. One side of the movable wedge has an inclined face or surface which mates with the inclined surface of the fixed wedge. The inclinations are such that as the movable wedge moves toward the longitudinal axis of the valve assembly, it exerts a force such as tends to push the fixed wedge (and the throat member) and the guide member apart. This increases the strength of the tool against exterior longitudinal loading forces. The guide member is held in position by a gusset support welded to the body of the valve and a threaded bolt screwed to a guide block parallel to the axis of the valve which may also be welded to the body or otherwise held in position.

Various objects and a better understanding of the invention can be had from the following description taken in conjunction with the drawings.

DETAILED DESCRIPTION OF THE PREFERRED EMBODIMENT

Figures 1, 2:
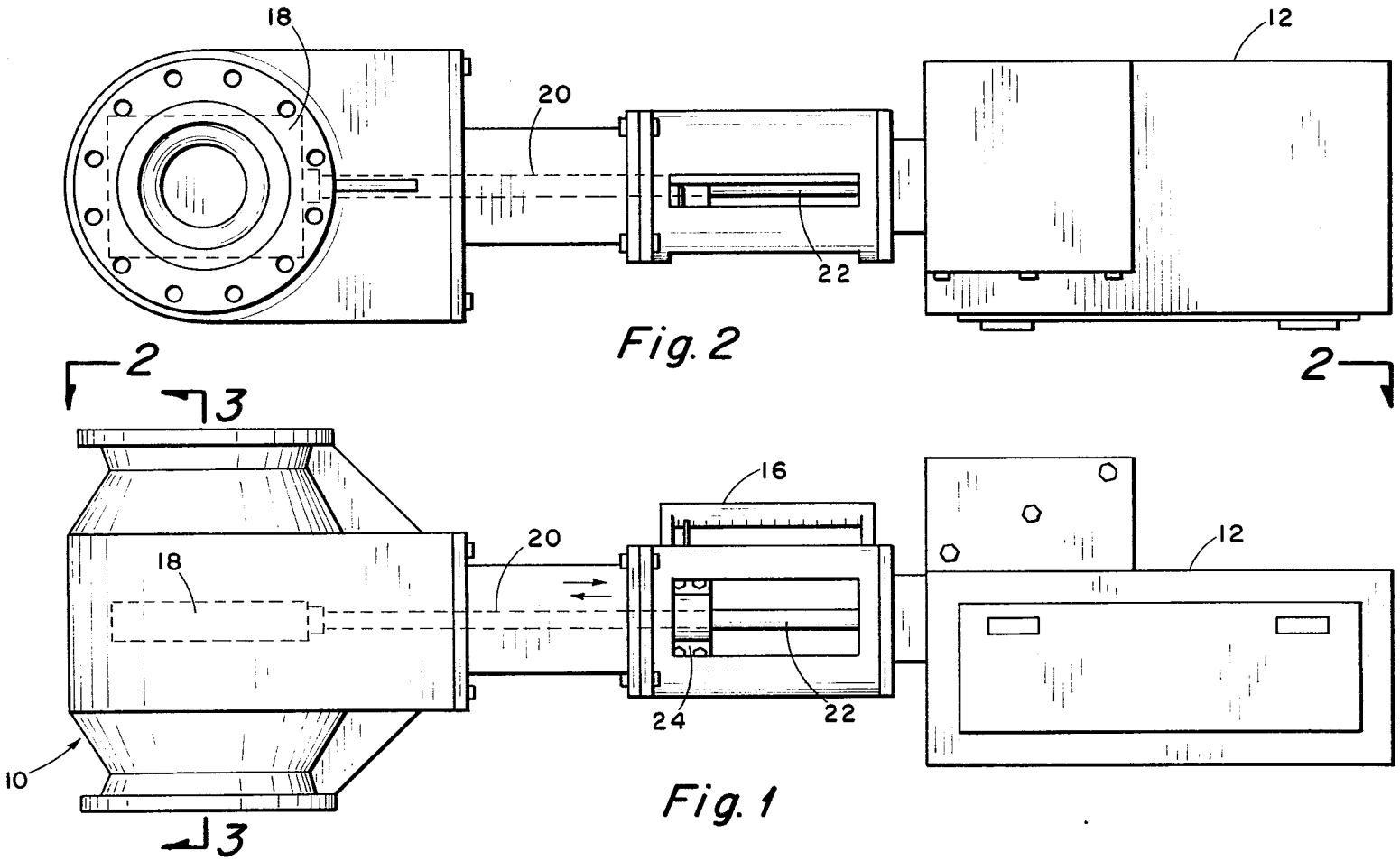
FIG. 1 is a side view of a slide valve assembly with external actuator and gate indicated therein.
FIG. 2 is a view taken along the line 2—2 of FIG. 1.

Attention is first directed to FIGS. 1 and 2 which shows a slide valve case 10 with an external actuator 12, which may be hydraulic and conventional, and a stuffing box 14 with valve opening indicator 16. Shown in dashed line is a gate or disc 18 which is connected by a spindle or shaft 20 to stem 22 by any well known connecting means 24. Stem 22 is connected to the actuator 12. The actuator 12 causes the valve 18 to move toward either the closed position indicated or to the right to an opened position or any position between the fully closed and fully opened position. The position of the gate 18 is shown by indicator 16. The general arrangement of the slide valve assembly of FIG. 1 and FIG. 2 may be conventional. The general concept of slide valves is well known so it is not believed that any further discussion of the general nature of the slide valve is essential.

Figure 3:
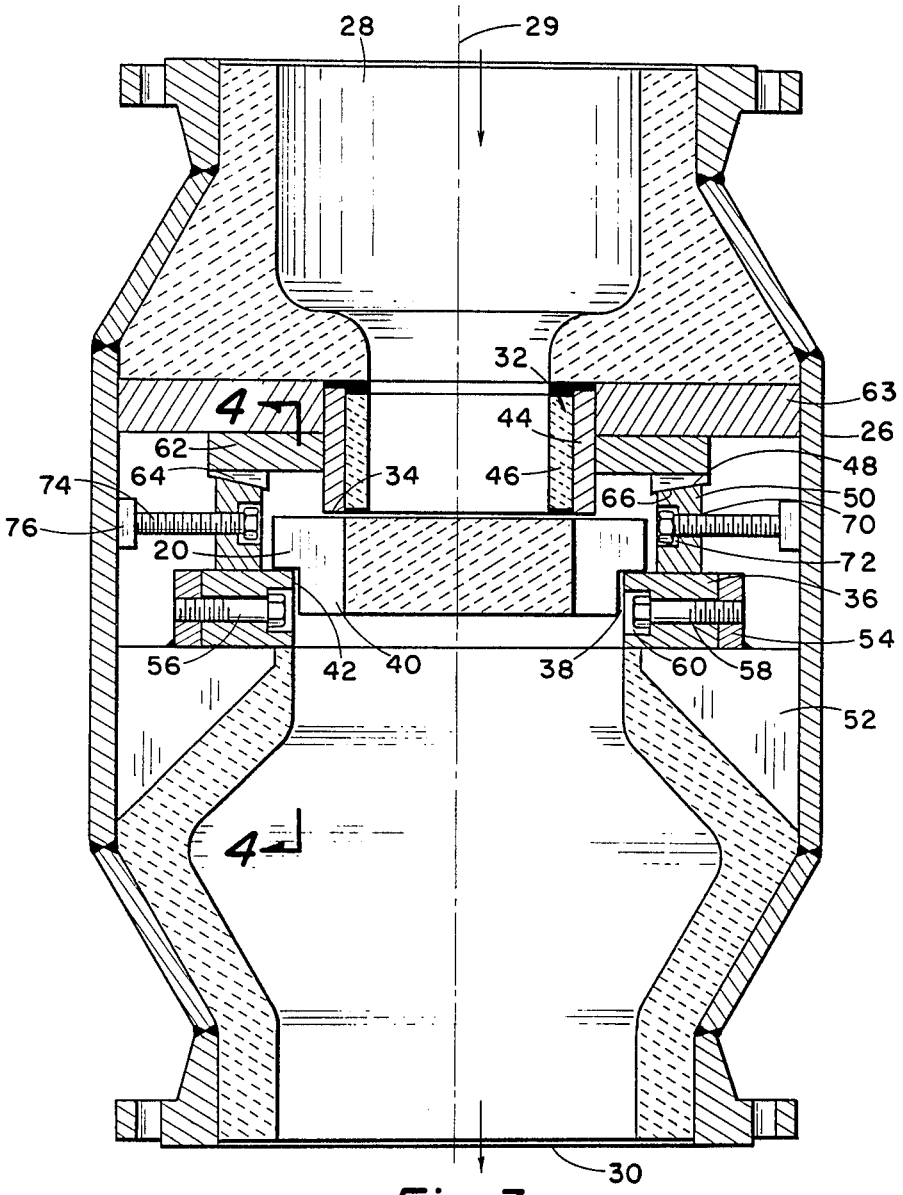
FIG. 3 is a view taken along the line 3—3 of FIG. 1.

Attention is next directed to FIG. 3 which shows a sliding valve housing 26 having an inlet 28 and an outlet 30 and a longitudinal axis 29. Provided therebetween is a throat member 32 and a gate valve 20. A top clearance is provided as clearance 34 between the bottom of throat 32 and the top of gate 20. The gate rides along a valve guide member 36. A side clearance is considered clearance 38 between the side of section 40 of gate 20 and the side 42 of guide member 36. Throat 32 may be made of a circular steel member 44 lined with a refractory material 46.

Guide member 36 is suitably supported so that it can be used with shims to adjust both the side clearance and the top clearance. Such support means will now be discussed. A supporting gusset 52 is provided for the guide 36 to rest on and an upright guide block 54 is welded to gusset 52 and is used in conjunction with bolt 56 to fix the position of the guide 36. Guide 36 is provided with a "clean bore" 58 with countersink 60. The bore 58 is slightly larger than the bolt 56. Thus, if it is desired to modify the top clearance 34 then shims can be provided between the guide 36 and the gusset 52. If it is desired to modify the side clearance 38, shims can be added between the guide 36 and the upright block 54.

The bottom side of the guide 50 rests on the top of guide 36. I shall now explain the means for holding the upper side of movable wedge 50. This includes a lateral member 62 which may be welded to steel member 44 of the throat which is supported from the valve body. A fixed wedge 64 is welded to or otherwise supported from lateral support member 62. The fixed wedge is thicker on the side nearest the throat and the side farthest from the throat is thinner. The direction of the slope of the face 66 is critical. It must be such that when movable wedge 50 is forced inwardly toward longitudinal axis 29 that there is force applied between guide 36 and lateral extension 62. I have found that an angle of about 10° with a line perpendicular to axis 29 works well but I am not limited to that particular angle. There is a lateral bore through movable wedge 50 with a countersink area 72. Bore 70 is tapped and jacking bolt 74 is threaded therethrough against block 76 which may be a part of the housing. In operation, as hot material flows through the valve, when the valve 20 is in its open position, the valve becomes exceedingly hot e.g., up to 1,800° F. This greatly reduces the tensil strength of steel and depending upon the steel and the temperature reached, it can drop from 70,000 pounds to 7,000 pounds or less. My invention helps compensate for this reduction in stength. As will be seen, as the temperature rises, jack bolt 74 expands and inasmuch as it is screwed to movable wedge 50, the wedge 50 is forced inwardly toward the axis 29. This forces the wedge even tighter therein. This applies a force (through the movable wedge and fixed wedge 64) between the gusset 52 and the lateral extension 62 which tends to force the gussett and extension apart. This greatly increases the integrity of the valve in the area in which the valve 20 must operate. This eliminates most of the sticking of the valve which may have occured in the prior art valves when the temperature becomes exceedingly high and which would occur if the wedges 48 and 50 had the inclination reversed from that of my invention as shown herein. The valve of my invention tends to stabilize the clearances 34 and 38 and thus prevent sticking.

As is apparent, my valve is very easily assembled and disassembled so to remove any of the guide member, the wedge, or the throat member. For example, the bonnet is removed and then by loosening or removing bolts 56 and 74, the guide 36 and the wedge 50 can be readily removed. The guide 36 is first removed and then the wedge 50 can drop out and be readily replaced. The assembly of the device, if the guide and the wedge are to be replaced, is just the reverse. The amount of a desired clearance, top clearance and side clearance is first determined and then calculations are made to see how much shims need to be added between the guide and the gusset and between the guide and the upright member or block. The valve can then be assembled and the clearances checked to see if they are correct and if not, adjustments can be made as necessary.

Figure 4:
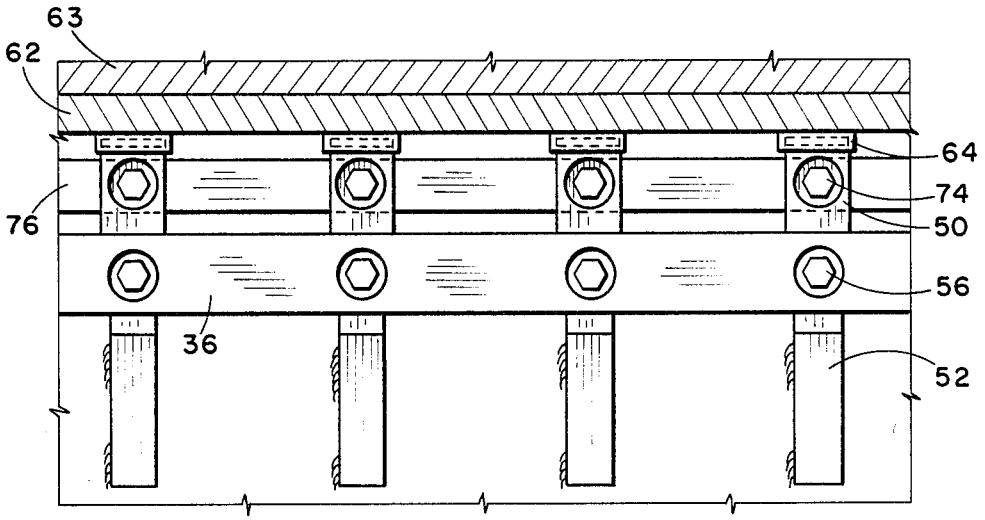
FIG. 4 is a view taken along the line 4—4 of FIG. 3.

In FIG. 4, the gate has been omitted and refractory material removed in order to show a clearer side view. As can be seen,, there are a plurality of movable wedge 50 spaced along guide member 36.

Figure 5:
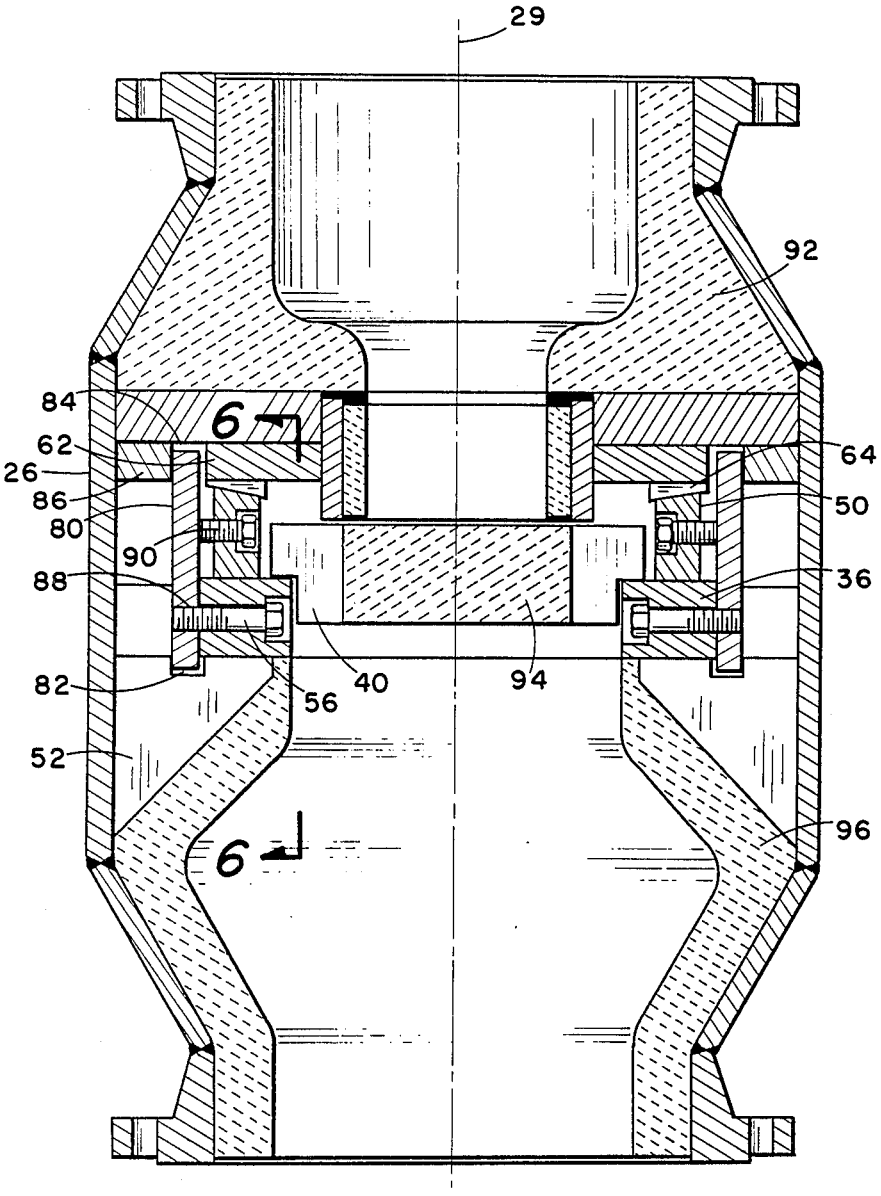
FIG. 5 is a view similar to FIG. 3 except that a different side support mechanism is provided for the wedge and the guide member.

Attention is now directed to FIG. 5. which shows a modification of the means to maintain the guide 36 and wedge 50 in their proper relationship. The embodiment shown in FIG. 5 does not have the vertical block 54 welded to gusset 52 as shown in FIG. 3. Rather, it has a removable bolting bar 80 which fits into notches 82 in gusset 52 and into notch 84 between lateral support 62 and a block 86 which is secured to the housing 26. Bolt 56 and guide 36 have the same relationship as that of FIG. 3. However, bolt 56 is screwed into threads 88 in a bore hole extending through removably bolting bar 80. Bolt 90 is comparable to jacking bolt 74 of FIG. 3 but is shorter inasmuch as it abuts against bolting bar 80 rather than against the housing wall. Bolts 56 and 90 can be tightened using an Allen wrench or any other suitable device very similar to that for loosening or tightening bolts 56 and 74 of FIG. 3. Bolting bar 80 is held tightly against the outer shoulder of notches 82 and 84 by tightening bolt 90. A suitable refractory material 92, 94 and 96 is added as indicated as may be done conventionally.

Figure 6:
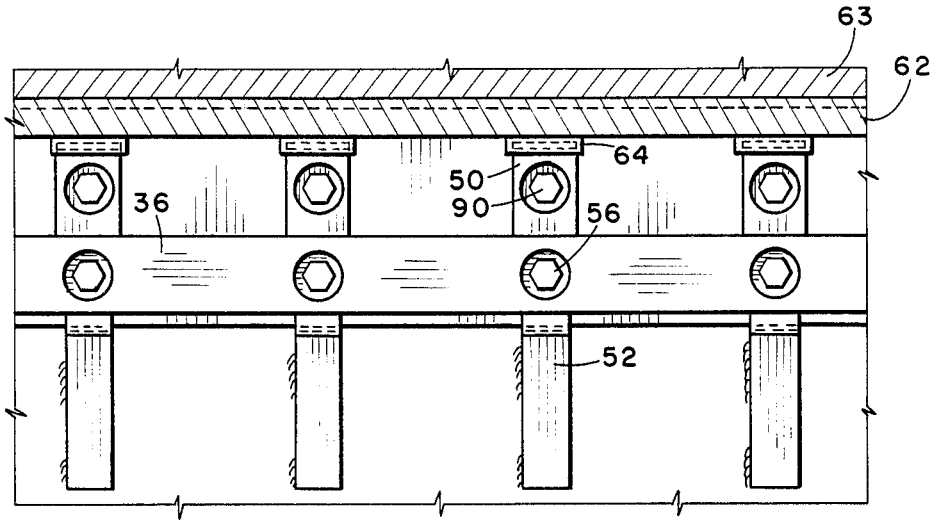
FIG. 6 is a view taken along the line 6—6 of FIG. 5.

In FIG. 6 the gate has been omitted and the refractory material removed in order to show a clearer side view. As can be seen, there is a plurality of movable wedges 50 spaced along guide member 36.

While this invention has been described with a certain degree of particularity, it is manifest than many changes may be made in the details of construction in the arrangement of components without departing from the spirit and scope of the disclosure. It is understood that the invention is not limited to the embodiment set forth herein for purposes of exemplification, but is limited only by the scope of the attached claim or claims, including the full range of equivalency to which each element thereof is entitled.

What is claimed:

1. A slide valve comprising:

a housing having an inlet and an outlet and a longitudinal axis extending therebetween;

a gate;

a guide member supported by said housing and having a first surface supporting said gate and along which said gate may slide;

a fixed wedge fixed with respect to said housing, said fixed wedge having a first inclined surface, said fixed wedge being thicker at the end closest to said longitudinal axis;

a movable wedge having an inclined surface mating with said first inclined surface, said movable wedge having a surface opposite its inclined surface for contacting said guide member.

2. A slide valve as defined in claim 1 in which said movable wedge has a bore essentially perpendicular to said longitudinal axis, said bore having threads thereon and also including;

a jack bolt threadily screwed through said bore.

3. A slide valve as defined in claim 2 in which said jack bolt is screwed against a base member which is positioned against said housing.

4. A slide valve as defined in claim 1 including means to retain said guide member in position, said means includes an upright block member fixed to a gusset which is fixed to said slide valve, a hole through said upright block and a hole through said guide member both of such holes essentially perpendicular to the longitudinal axis of said valve and a bolt screwed into threads in the hole in said upright block.

5. A slide valve as defined in claim 1 including a gusset secured to said housing, said gusset having an upper side with a first notch therein; a second notch provided above said first inclined surface; and a bolting bar positioned in said first and second notches, said guide member being further limited to have a bore therethrough essentially perpendicular to said longitudinal axis; and a bolt extending cleanly through said bore into a threaded bore in said bolting bar.

6. A valve as defined in claim 5 in which said movable wedge member has a tapped bore therethrough and a jack bolt extending through said bore and contacting one side of said bolting bar.

* * * * *